US008406676B2

(12) United States Patent
Taguma

(10) Patent No.: US 8,406,676 B2
(45) Date of Patent: Mar. 26, 2013

(54) IMAGE FORMING APPARATUS AND IMAGE FORMING METHOD

(75) Inventor: Kenichi Taguma, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 321 days.

(21) Appl. No.: 12/559,989

(22) Filed: Sep. 15, 2009

(65) Prior Publication Data

US 2010/0080602 A1 Apr. 1, 2010

(30) Foreign Application Priority Data

Sep. 26, 2008 (JP) ..... 2008-248277

(51) Int. Cl.
*G03G 21/00* (2006.01)

(52) U.S. Cl. ..... 399/346

(58) Field of Classification Search ..... 399/55, 399/222, 252, 346

See application file for complete search history.

(56) References Cited

U.S. PATENT DOCUMENTS

| | | | | |
|---|---|---|---|---|
| 2003/0044201 | A1* | 3/2003 | Kosuge | 399/223 |
| 2006/0210334 | A1* | 9/2006 | Tokumasu et al. | 399/346 |
| 2008/0069614 | A1* | 3/2008 | Shintani et al. | 399/346 |

FOREIGN PATENT DOCUMENTS

| | | | |
|---|---|---|---|
| JP | 10-49018 | | 2/1998 |
| JP | 10-97158 | | 4/1998 |
| JP | 2962919 | | 8/1999 |
| JP | 11-288194 | A | 10/1999 |
| JP | 2002244485 | A * | 8/2002 |
| JP | 2005-249917 | A | 9/2005 |
| JP | 2005-308831 | A | 11/2005 |
| JP | 2008-180789 | A | 8/2008 |

OTHER PUBLICATIONS

Machine translation of JP 2002244485.*

Japanese Office Action Issued Nov. 13, 2012 in Patent Application No. 2008-248277.

* cited by examiner

*Primary Examiner* — Walter L Lindsay, Jr.
*Assistant Examiner* — Barnabas Fekete
(74) *Attorney, Agent, or Firm* — Oblon, Spivak, McClelland, Maier & Neustadt, L.L.P.

(57) ABSTRACT

An image forming apparatus includes an image carrier carrying a latent image, a charging device uniformly charging a surface of the image carrier, an exposure device performing, in accordance with image data, an exposure operation on the charged image carrier surface to write the latent image, a development device supplying toner to the latent image to develop a visible image, a transfer device transferring the visible image to an intermediate transfer member or a recording medium, a lubricant application device applying lubricant to the image carrier surface, a cleaning device cleaning the image carrier surface after a transfer operation, a fixing device fixing the transferred image on the recording medium, and a control device controlling, in accordance with recent print information, the operation in a lubricant application mode in which the lubricant application device applies the lubricant to the image carrier surface.

5 Claims, 6 Drawing Sheets

IMAGE FORMING APPARATUS AND IMAGE FORMING METHOD

CROSS-REFERENCE TO RELATED APPLICATIONS

The present invention claims priority pursuant to 35 U.S.C. §119 from Japanese Patent Application No. 2008-248277, filed on Sep. 26, 2008 in the Japan Patent Office, which is hereby incorporated by reference herein in its entirety.

BACKGROUND OF THE INVENTION

1. Field of the Invention

Exemplary embodiments of the present invention generally relate to an image forming apparatus such as an electrophotographic copier, facsimile machine, printer, plotter, multifunctional machine, or printing machine, and an image forming method. In particular, exemplary embodiments of the present invention relate to an image forming apparatus and method using a cleaning blade as a cleaning device which cleans residual toner remaining on an image carrier.

2. Discussion of the Background Arts

Generally, in an image forming apparatus using an electrostatic photography process, an electrostatic latent image corresponding to the image of a document is formed on a surface of a rotary photoconductor previously charged to a predetermined polarity and serving as an image carrier. The electrostatic latent image is developed by a development unit provided at a predetermined position around the photoconductor. That is, with fine powder toner charged and supplied from the development unit, the electrostatic latent image is developed into a visible image. As the photoconductor rotates, the toner image formed on the photoconductor reaches a transfer unit to be transferred to a sheet-like medium, i.e., a so-called transfer material (hereinafter referred to as the recording sheet) conveyed to the transfer unit. Thereafter, the toner image transferred to the recording sheet is fixed thereon by a fixing device. Further, after the transfer of the toner image to the recording sheet, residual toner remaining on the photoconductor is removed by a cleaning device provided at a predetermined position around the photoconductor.

In an image forming apparatus which removes the toner remaining on the photoconductor by using a cleaning blade, abnormal noise occurs in some cases due to friction between the photoconductor and the cleaning blade (hereinafter referred to as blade squeak). The blade squeak tends to occur particularly when the photoconductor is rotated at a relatively low speed or is about to stop.

In view of the above, according to a background technique, in an image forming apparatus in which a photoconductor having a surface layer formed by a bisphenol Z polycarbonate resin is cleaned by a cleaning blade formed by a polyurethane rubber, each of characteristic values of the cleaning blade is specified in a certain range to prevent the blade squeak. Specifically, the background technique specifies the hardness of the cleaning blade in a range of from 60 degrees to 80 degrees, and the rebound resilience of the cleaning blade in a range of from 10% to 65%. Further, the background technique specifies the absolute value of the charge amount of the residual toner as in a range of from 5 μC/g (micro Coulomb per gram) to 50 μC/g. With some types of toner, however, it is difficult to prevent the blade squeak. It is also difficult to prevent the blade squeak when the photoconductor is rotated at a relatively low speed.

To prevent such inconvenience, another background technique specifies the characteristic values of the cleaning blade and the absolute value of the charge amount of the residual toner to prevent the blade squeak. Further, this background technique provides a weight inside the photoconductor, and specifies a particular weight ratio between the photoconductor and the weight to prevent the blade squeak.

In an attempt to prevent the blade squeak by regulating the characteristic values of the cleaning blade, as in the first type of background technique, the blade squeak may still occur due to variation in the characteristic values of the cleaning blade. Further, cleaning failure may occur because the characteristic values are unsuitable for attaining the required level of cleaning performance. Further still, the incidence of abnormal noise tending to occur in a relatively low temperature environment (hereinafter referred to as blade chatter) may increase.

Meanwhile, the second background technique described above can prevent the blade squeak due to the friction between the photoconductor and the cleaning blade and the abnormal noise such as blade chatter. Further, the second background technique is advantageous in that, for example, the blade characteristic values can be set to be suitable for attaining the required cleaning performance. However, the provision of the extra weight inside the photoconductor undesirably increases the costs. Further, the weight may be misaligned depending on how the weight is installed, resulting in a variety of troubles.

SUMMARY OF THE INVENTION

Exemplary aspects of the present invention have been made in view of the above described circumstances and provide an image forming apparatus that prevent abnormal noise occurring due to a friction between an image carrier and a cleaning member.

Other exemplary aspects of the present invention provide an image forming method for the above-described image forming apparatus.

In one exemplary embodiment, an image forming apparatus includes an image carrier, a charging device, an exposure device, a development device, a transfer device, a lubricant application device, a cleaning device, a fixing device, and a control device. The image carrier is configured to be driven to rotate and carry a latent image on a surface thereof. The charging device is configured to uniformly charge the surface of the image carrier. The exposure device is configured to perform, on the basis of image data, an exposure operation on the charged surface of the image carrier to write the latent image thereon. The development device is configured to supply toner to the latent image to develop the latent image into a visible image. The transfer device is configured to transfer the visible image to one of an intermediate transfer member and a recording medium. The lubricant application device is configured to apply lubricant to the surface of the image carrier. The cleaning device is configured to clean the surface of the image carrier subjected to a transfer operation. The fixing device is configured to fix, on the recording medium, the image transferred thereto. The control device is configured to control, on the basis of recent print information, the operation in a lubricant application mode in which the lubricant application device applies the lubricant to the surface of the image carrier.

The above-described image forming apparatus may further include an image area calculation device to calculate an image area of the visible image, an image area ratio calculation device to calculate an image area ratio representing a ratio of the image area to a movement area of the image carrier, and an average image area ratio calculation device to calculate an average image area ratio representing an average value of the image area ratios of recently printed images. The control device may use one of the image area ratio, the average image area ratio, and a calculation value calculated on the basis of the average image area ratio as the print information for controlling the operation of the lubricant application device in the lubricant application mode.

The above-described image forming apparatus may further include a print number counting device to count a number of recording media printed to obtain a print number. The control device may use the print number as the print information for controlling the operation of the lubricant application device in the lubricant application mode.

An image forming operation may be performed using a plurality of printing speeds. The control device may use the plurality of printing speeds as the print information for controlling the operation of the lubricant application device in the lubricant application mode.

The control device may control the operation of the lubricant application device in the lubricant application mode by changing a lubricant application time during which the lubricant application device applies the lubricant to the surface of the image carrier.

The control device may control the operation of the lubricant application device in the lubricant application mode by changing a lubricant application speed at which the lubricant application device applies the lubricant to the surface of the image carrier.

The lubricant application mode may be executed during a fixing reload time of the fixing device.

The lubricant application mode may be executed in an interval between successively conveyed recording media in the image forming operation.

Further in one exemplary embodiment, an image forming method for the above-described image forming apparatus includes rotating an image carrier, uniformly charging a surface of the image carrier, exposing, on the basis of acquired image data, the charged surface of the image carrier to write a latent image thereon, supplying toner to the latent image carried on the surface of the image carrier to develop the latent image into a visible image, transferring the visible image to one of an intermediate transfer member and a recording medium in a transfer operation, applying lubricant to the surface of the image carrier by using a lubricant application device, cleaning the surface of the image carrier subjected to the transfer operation by using a cleaning device, setting a variable idling time of the image carrier on the basis of recent print information, idling the image carrier in contact with the lubricant application device and the cleaning device, to apply the lubricant to the surface of the image carrier and clean the surface of the image carrier in preparation for a subsequent image forming operation, and fixing, on the recording medium, the image transferred thereto.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF PREFERRED EMBODIMENTS

Figure 1:
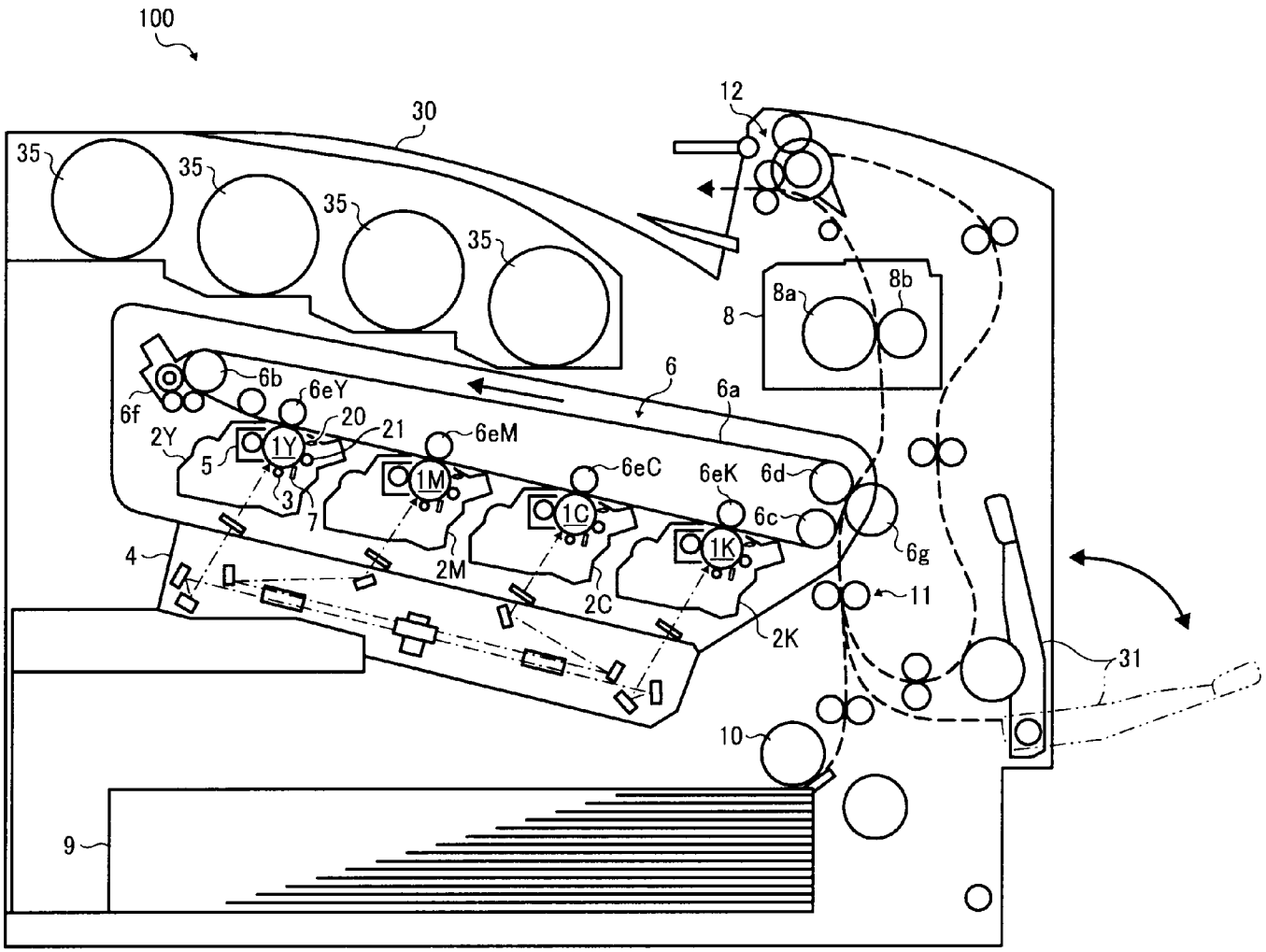
FIG. 1 is a schematic diagram illustrating a configuration of an image forming apparatus according to an embodiment of the present invention.

In describing the embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner.

Referring now to the drawings, wherein like reference numerals designate identical or corresponding parts throughout the several views, particularly to FIG. 1, an embodiment of the present invention applied to an electrophotographic image forming apparatus 100 will be described below.

FIG. 1 is a schematic diagram illustrating the image forming apparatus 100 according to an embodiment of the present invention. The image forming apparatus 100 forms a color image by using toners of four colors, i.e., yellow, magenta, cyan, and black (hereinafter referred to as Y, M, C, and K, respectively). This type of image forming apparatus will be referred to as a tandem-type image forming apparatus.

The image forming apparatus 100 mainly includes four image forming units 2Y, 2M, 2C, and 2K (alternatively referred to collectively as the image forming units 2), an exposure device 4, a transfer device 6 including an intermediate transfer belt 6*a* and so forth, a fixing device 8, a sheet feeding cassette 9, a sheet discharging tray 30, manual sheet feeding tray 31, four toner bottles 35, and so forth.

The image forming units 2Y, 2M, 2C, and 2K include four photoconductors 1Y, 1M, 1C, and 1K, respectively (alternatively referred to collectively as the photoconductors 1). Further, each of the image forming units 2 includes a charging device 3, a development device 5, a cleaning device 7, a pre-cleaning diselectrification device (hereinafter referred to as PCL) 20, and a lubricant applying and cleaning device 21.

Each of the photoconductors 1Y, 1M, 1C, and 1K serves as an image carrier for carrying thereon a latent image and a toner image. In the present embodiment, the photoconductors 1 are drum-shaped, for example. Alternatively, belt-like photoconductors may also be employed. Being in contact with the intermediate transfer belt 6*a*, which is a member having a movable surface, the photoconductors 1Y, 1M, 1C, and 1K are driven to rotate in the same direction as the intermediate transfer belt 6*a* at respective contact positions at which the photoconductors 1Y, 1M, 1C, and 1K are in contact with the intermediate transfer belt 6*a*. That is, the intermediate transfer belt 6*a* is driven to rotate in the counterclockwise direction. Meanwhile, the photoconductors 1Y, 1M, 1C, and 1K in contact with the intermediate transfer belt 6*a* are driven to rotate in the clockwise direction.

Figure 2:
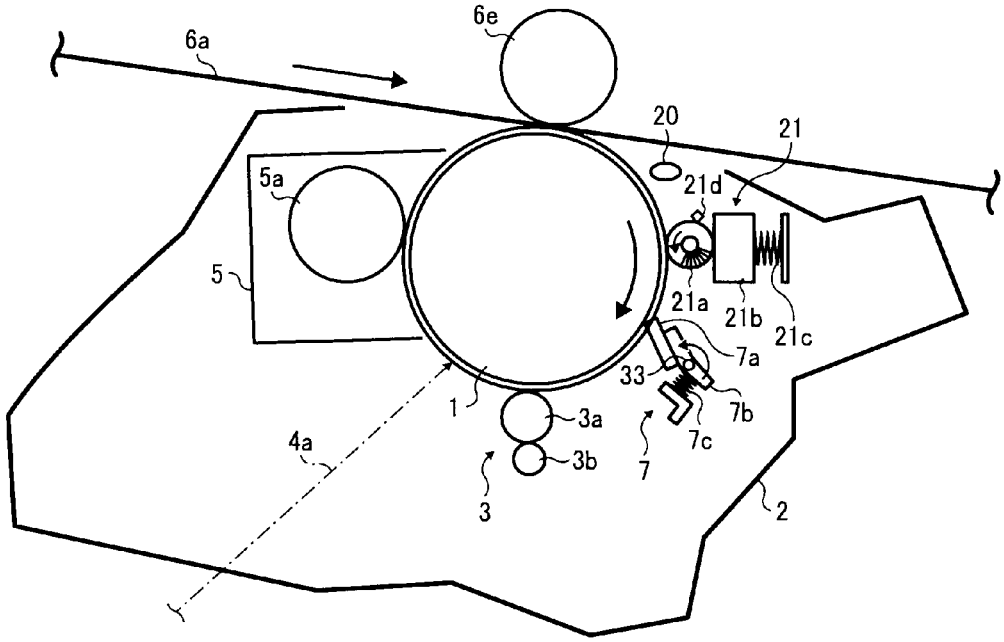
FIG. 2 is a diagram illustrating an enlarged view of an image forming unit extracted from the image forming apparatus.

FIG. 2 is a schematic diagram illustrating an enlarged view of a part of the image forming apparatus 100 illustrated in FIG. 1, as extracted from the image forming apparatus 100. The drawing illustrates the configuration of the image forming units 2 including the photoconductors 1. The configuration around the photoconductor is the same among the photoconductors 1Y, 1M, 1C, and 1K in the image forming units 2Y, 2M, 2C, and 2K in FIG. 1. Therefore, FIG. 2 illustrates one image forming unit 2, wherein the reference letter Y, M, C, or K for color distinction is omitted.

Figure 3:
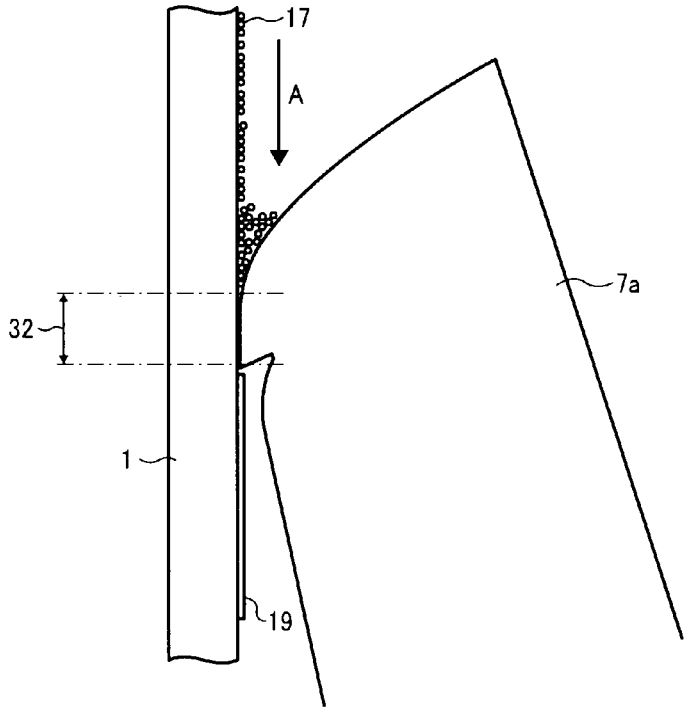
FIG. 3 is a diagram illustrating an enlarged view of a state in which a cleaning member is in contact with a photoconductor drum.

With reference to FIGS. 1 to 3 as necessary, the configuration of the image forming apparatus 100 will be described below. As illustrated in FIG. 2, the development device 5, the PCL 20, the lubricant supplying and cleaning device 21, the cleaning device 7, and the charging device 3 are sequentially disposed around the photoconductor 1 in the moving direction of a surface of the photoconductor 1, i.e., in the direction indicated by the corresponding arrow in the drawing.

The development device 5 serves as a development device which supplies toner to a latent image formed on the surface of the photoconductor 1 to develop the latent image into a visible toner image. The PCL 20 diselectrifies the charge potential of the photoconductor 1. The lubricant supplying and cleaning device 21 supplies lubricant to the surface of the photoconductor 1, and cleans residual toner off the surface of the photoconductor 1. The cleaning device 7 cleans the residual toner off the surface of the photoconductor 1, and spreads the lubricant supplied to the surface of the photoconductor 1 into a thin layer. The charging device 3 serves as a charging device which uniformly charges the surface of the photoconductor 1.

The charging device 3 charges the surface of the photoconductor 1 to the negative polarity. The charging device 3 of the present embodiment includes a charging roller 3*a* and a cleaning roller 3*b*. The charging roller 3*a* serves as a charging member which performs a charging process in a so-called contact or proximity charging method. That is, the charging device 3 brings the charging roller 3*a* into contact or proximity with the surface of the photoconductor 1, and applies a negative polarity bias voltage to the charging roller 3*a*. Thereby, the surface of the photoconductor 1 is charged.

The charging roller 3*a* is applied with a direct-current charging bias voltage such that the photoconductor 1 is charged to have a surface potential of approximately −400 volts to approximately −500 volts. As the charging bias voltage, a direct-current bias voltage superimposed with an alternating-current bias voltage may also be used. The charging device 3 also includes the cleaning roller 3*b* which cleans a surface of the charging roller 3*a*. The cleaning roller 3*b*, which is formed by a metal roller shaft and a melamine resin foam provided around the outer circumference of the roller shaft, has a function of removing foreign substances adhering to the surface of the charging roller 3*a*.

The charging device 3 may be configured such that a thin film is wound around opposite end portions on the circumferential surface of the charging roller 3*a* in the axial direction thereof, and the thus configured charging device 3 may be provided to be in contact with the surface of the photoconductor 1. With this configuration, the surface of the charging roller 3*a* and the surface of the photoconductor 1 are substantially proximate to each other, with the two surfaces apart from each other by a distance corresponding to the thickness of the film. Accordingly, it is possible to suppress the contact of the charging roller 3*a* with the residual toner on the surface of the photoconductor 1.

In a space between the charging roller 3*a* and the development device 5, the surface of the photoconductor 1 charged as described above is exposed by scanning light 4*a* emitted from the exposure device 4 serving as an exposure device. Thereby, the surface of the photoconductor 1 is formed with an electrostatic latent image of the corresponding color. On the basis of image information of the corresponding color, the exposure device 4 emits the scanning light 4*a* of the corresponding color to the photoconductor 1 of the corresponding color. Thereby, an electrostatic latent image is written on the photoconductor 1. The exposure device 4 of the present embodiment is an exposure device using a laser system. Alternatively, an exposure device using another system, such as an exposure device including an LED (Light-Emitting Diode) array and an imaging device, may also be employed.

The development device 5 includes a development roller 5*a* serving as a developer carrying member and partially exposed from an opening formed in a casing of the development device 5. The present embodiment uses a two-component developer including toner and carrier. Alternatively, a one-component developer not including carrier may also be used. The development device 5 receives a supply of toner of the corresponding color from the corresponding toner bottle 35 (see FIG. 1), and stores the toner therein. The development roller 5*a* is formed by a magnet roller serving as a magnetic field generation device and a development sleeve coaxially rotating around the magnet roller.

Due to the magnetic force generated by the magnet roller, the carrier in the developer stands in the form of spikes on the surface of the development roller 5*a*, and is conveyed to a development area facing the photoconductor 1. In this process, in the development area in which the development roller 5*a* faces the photoconductor 1, the surface of the development roller 5*a* moves in the same direction as the surface of the photoconductor 1 at a linear velocity faster than the linear velocity of the surface of the photoconductor 1. Then, the carrier standing in the form of spikes on the surface of the development roller 5*a* rubs against the surface of the photoconductor 1 to supply the surface of the photoconductor 1 with the toner adhering to the surface of the carrier. Thereby, the development process is performed. In this process, the development roller 5*a* is applied with a development bias voltage of approximately −300 volts from a power supply (not illustrated). Thereby, a development electric field is formed in the development area.

Above the photoconductor 1, the transfer device 6 is provided which includes a primary transfer roller 6*e* serving as a transfer device for transferring the visible toner image on the photoconductor 1 to a recording medium. The present embodiment employs an intermediate transfer belt system, in which the respective toner images on the photoconductors 1 are first transferred to the intermediate transfer belt 6*a* and then to the final sheet-like recording medium (alternatively referred to as a recording sheet, a transfer sheet, or a recording material).

As illustrated in FIG. 1, the intermediate transfer belt 6*a* of the transfer device 6 is configured to be stretched over three support rollers 6*b*, 6*c*, and 6*d* and circularly move in the direction indicated by the corresponding arrow in the drawing. The respective toner images on the photoconductors 1Y, 1M, 1C, and 1K are sequentially transferred to the intermediate transfer belt 6*a* from the upstream side in accordance with an electrostatic transfer method to be superimposed on one another.

Some configurations according to the electrostatic transfer method use transfer chargers. The present embodiment, however, employs a configuration using the primary transfer rollers 6*e*, which generate a relatively small amount of transfer dust. Specifically, the primary transfer rollers 6*e* (i.e., primary transfer rollers 6*e*Y, 6*e*M, 6*e*C, and 6*e*K in FIG. 1) each serving as a transfer device are provided on respective portions of the back surface of the intermediate transfer belt 6*a* in contact with the photoconductors 1Y, 1M, 1C, and 1K. In the present embodiment, the photoconductors 1Y, 1M, 1C, and 1K and the respective portions of the intermediate transfer belt 6*a* pressed by the primary transfer rollers 6*e*Y, 6*e*M, 6*e*C, and 6*e*K form respective primary transfer areas.

In the transfer process of the respective toner images on the photoconductors 1Y, 1M, 1C, and 1K to the intermediate transfer belt 6*a*, the primary transfer rollers 6*e*Y, 6*e*M, 6*e*C, and 6*e*K are applied with a positive polarity bias voltage. Thereby, a transfer electric field is formed in the respective primary transfer areas in which the primary transfer process is performed. Further, the toner images on the photoconductors 1Y, 1M, 1C, and 1K electrostatically adhere to the intermediate transfer belt 6*a* to be transferred thereto. Some image forming apparatuses employ a method which directly transfers toner images on photoconductors to a recording medium without using an intermediate transfer belt. The present invention is also applicable to such image forming apparatuses.

At a position around the intermediate transfer belt 6*a* and upstream of the most upstream image forming unit 2Y, a belt cleaning device 6*f* is provided to remove toner remaining on the surface of the intermediate transfer belt 6*a*. The belt cleaning device 6*f* is configured to collect unnecessary toner adhering to the surface of the intermediate transfer belt 6*a* by using a fur brush and a cleaning blade.

The collected unnecessary toner is conveyed from the belt cleaning device 6*f* to a waste toner tank (not illustrated) through a conveying device (not illustrated). The intermediate transfer belt 6*a* is a high-resistivity circular belt formed by a single layer, and has a volume resistivity of approximately $10^9$ Ωcm (ohm centimeters) to approximately $10^{11}$ Ωcm. The material forming the intermediate transfer belt 6*a* is preferably PVDF (polyvinylidene fluoride). Alternatively, the intermediate transfer belt 6*a* may be formed by a plurality of resin layers including an elastic layer.

A portion of the intermediate transfer belt 6*a* stretched by the support roller 6*d* is in contact with a secondary transfer roller 6*g*. Between the secondary transfer roller 6*g* and the intermediate transfer belt 6*a*, a secondary transfer area is formed. The recording medium is conveyed into the secondary transfer area at predetermined timing.

The recording medium is stored in the sheet feeding cassette 9 provided below the exposure device 4 in FIG. 1, and is conveyed to the secondary transfer area by a pickup roller 10, a registration roller pair 11, and so forth. Then, in the secondary transfer area, the toner images superimposed on the intermediate transfer belt 6*a* are transferred at one time to the recording medium. In the secondary transfer process, the secondary transfer roller 6*g* is applied with a positive polarity bias voltage. Thereby, a transfer electric field is formed, and the toner images on the intermediate transfer belt 6*a* are transferred to the recording medium due to the transfer electric field.

As illustrated in FIG. 2, the lubricant supplying and cleaning device 21 mainly includes a solid-state lubricant 21*b* stored in a case, a lubricant supplying and cleaning member 21*a*, a pressure spring 21*c*, and a removing member 21*d*. The lubricant supplying and cleaning member 21*a* has one side in pressure-contact with the photoconductor 1 to clean the residual toner off the surface of the photoconductor 1. At the same time, the lubricant supplying and cleaning member 21*a* has the other side in contact with the lubricant 21*b* to scrape and apply the lubricant 21*b* to the surface of the photoconductor 1. The pressure spring 21*c* presses the lubricant 21*b* against the lubricant supplying and cleaning member 21*a*. The removing member 21*d* scrapes off residual toner accumulated on the lubricant supplying and cleaning member 21*a* during the cleaning of the residual toner on the photoconductor 1.

The lubricant supplying and cleaning member 21*a* of the present embodiment is a brush roller, but may be replaced by a rubber roller or a sponge roller. The lubricant 21*b* is formed into a rectangular parallelepiped. The lubricant supplying and cleaning member 21*a* has an elongated shape extending in the axial direction of the photoconductor 1. The lubricant 21*b* is biased toward the lubricant supplying and cleaning member 21*a* by the pressure spring 21*c* so that almost all of the lubricant 21*b* can be used up.

The lubricant 21*b* is expendable, and thus is reduced in thickness over time. The lubricant 21*b*, however, is pressed by the pressure spring 21*c* to be constantly in contact with the lubricant supplying and cleaning member 21*a*. In the present embodiment, the pressure force applied by the pressure spring 21*c* is set to be approximately 500 mN (milli-Newtons). The removing member 21*d*, which is formed by a flicker, may be replaced by a brush roller or a blade. The surface of the lubricant supplying and cleaning member 21*a* is constantly cleaned by the removing member 21*d*. Therefore, the lubricant supplying and cleaning member 21*a* can stably perform the supply of the lubricant 21*b* and the cleaning operation for a relatively long time. Accordingly, the life of the lubricant supplying and cleaning member 21*a* is increased.

The lubricant 21*b* includes fatty acid metal salt, silicone oil, fluorine resin, and so forth. These materials can be used singly or in combination of two or more. In particular, fatty acid metal salt is preferable. As the fatty acid of the fatty acid metal salt, straight-chain hydrocarbon is preferable. For example, myristic acid, palmitic acid, stearic acid, and oleic acid are preferable. In particular, stearic acid is preferable. The metal of the fatty acid metal salt includes lithium, magnesium, calcium, strontium, zinc, cadmium, aluminum, cerium, titanium, iron, and so forth. Among these substances, zinc stearate, magnesium stearate, aluminum stearate, and iron stearate are preferable. In particular, zinc stearate is preferable.

The cleaning device 7 includes a cleaning member (e.g., a cleaning blade) 7*a*, a support member 7*b* having a shaft portion 33, and a blade pressure spring 7*c*. FIG. 3 is an enlarged view illustrating a state in which the cleaning member 7*a* forming a part of the cleaning device 7 is in contact with the photoconductor 1. The cleaning member 7*a*, which removes the residual toner and impurities from the surface of the photoconductor 1, also serves as a device for spreading powdery lubricant 17 (i.e., the lubricant 21*b*) into a thin layer.

As described above, the lubricant supplying and cleaning member 21*a* and the cleaning member 7*a* both have a function of applying lubricant to the surface of the photoconductor 1 and a function of cleaning the surface of the photoconductor 1 after the transfer process, and thus serve as a cleaning device and a lubricant applying device.

The cleaning member 7*a* is formed by a rubber member, which is a rectangular elastic body. With the use of the rubber member, it is possible to bring the cleaning member 7*a* into contact with the photoconductor 1 such that the cleaning member 7*a* bites into or is pressed into the photoconductor 1 by a certain amount. As a result, the cleaning member 7*a* is pressed against the photoconductor 1 and deformed to form a nip portion 32.

Similarly to the toner, the powdery lubricant 17 stays in the nip portion 32 formed by the cleaning member 7*a*. Then, due to the pressure applied by the cleaning member 7*a*, the powdery lubricant 17 passes through the nip portion 32 in the form of a thin-layer lubricant 19 formed on the surface of the photoconductor 1. If the powdery lubricant 17 applied by the lubricant supplying and cleaning device 21 is sufficiently fine powder, the cleaning member 7*a* can spread the powdery lubricant 17 into a thin layer on the surface of the photoconductor 1 at a molecular layer level.

The thinner the thin-layer lubricant 19 is, the better lubrication performance the thin-layer lubricant 19 exerts. Meanwhile, if the powdery lubricant 17 in a coarse powder state enters into the nip portion 32 formed by the cleaning member 7*a*, extra lubricant exceeding the amount used for the thin layer remains on the photoconductor 1, and the extra lubricant in the powder state passes through the nip portion 32. As a result, the extra lubricant adheres to the photoconductor 1, and causes contamination of the charging device 3. Further, an uneven lubricant layer is formed on the surface of the photoconductor 1, and causes an adverse effect on the development, transfer, and cleaning processes.

As described above, the photoconductor 1 rotates in the direction indicated by an arrow A in FIG. 3, and the rubber member forming the cleaning member 7*a* is provided to come into contact with the photoconductor 1 in the opposite direction to the rotation direction indicated by the arrow A. With the cleaning member 7*a* thus brought into contact with the photoconductor 1 in the opposite direction, the powdery lubricant 17 is uniformly applied with pressure in the nip portion 32 formed by the cleaning member 7*a*. Accordingly, the powdery lubricant 17 can be effectively spread into the thin-layer lubricant 19 and adhere to the photoconductor 1.

As illustrated in FIG. 2, the cleaning device 7 includes the cleaning member 7*a*, the support member 7*b* which supports the cleaning member 7*a* and is swingable around the shaft portion 33 acting as a fulcrum, and the blade pressure spring 7*c* which applies pressure to one side of the support member 7*b*. With the pressure applied by the blade pressure spring 7*c*, the cleaning member 7*a* swinging around the shaft portion 33 acting as the fulcrum is pressed against the photoconductor 1.

Along with the rotation of the photoconductor 1, the cleaning member 7*a* pressed against the photoconductor 1 comes into sliding contact with the photoconductor 1. Thereby, the cleaning member 7*a* removes the toner remaining on the surface of the photoconductor 1 after the transfer process and not removed in the cleaning by the lubricant supplying and cleaning device 21. Further, the cleaning member 7*a* spreads the lubricant 21*b* supplied on the surface of the photoconductor 1 by the lubricant supplying and cleaning device 21 into a thin layer.

The cleaning member 7*a* is pasted to the support member 7*b*. Although the material forming the support member 7*b* is not particularly limited, materials such as metal, plastic, and ceramic can be used to form the support member 7*b*. The material forming cleaning member 7*a* includes an elastic material having a relatively low friction coefficient, such as urethane elastomer, silicone elastomer, and fluorine elastomer among urethane resin, silicone resin, fluorine resin, and so forth. As the material forming the cleaning member 7*a*, a thermosetting urethane resin is preferable. In particular, urethane elastomer is preferable in terms of abrasion resistance, ozone resistance, and contamination resistance. Elastomer includes rubber.

The cleaning member 7*a* preferably has a hardness (JIS-A) in a range of from approximately 65 degrees to approximately 85 degrees. Further, the cleaning member 7*a* preferably has a thickness in a range of from approximately 0.8 millimeters to approximately 3.0 millimeters, and a projection amount in a range of from approximately 3 millimeters to approximately 15 millimeters. The other conditions such as the contact pressure, the contact angle, and the bite amount can be determined as required.

With reference to FIGS. 1 and 2, the image forming operation of the image forming apparatus 100 according to the present embodiment will be described. Upon start of the image forming operation, the charging device 3 first uniformly charges the surface of the photoconductor 1 to the negative polarity. In this process, impurities such as residual toner and lubricant adhering to the charging roller 3*a* are cleaned off by the cleaning roller 3*b*.

Then, while scanning the surface of the photoconductor 1, the exposure device 4 applies the scanning light 4*a* emitted from the laser to the surface of the photoconductor 1 on the basis of the image data. Thereby, a latent image is formed. The latent image is developed into a visible toner image by the development device 5. A two-component developer containing magnetic carrier is preferably used as the toner in consideration that the two-component developer makes it easier to handle color toners.

In the above process, the photoconductor 1 formed with the toner image rotates and reaches the primary transfer area. In the primary transfer area, the photoconductor 1 comes into contact with the intermediate transfer belt 6*a* moved into the area at the same time. Further, in the primary transfer area, the toner image developed on the photoconductor 1 is transferred to the intermediate transfer belt 6*a* due to the action of the transfer electric field and nip pressure. With this transfer process, the toner image is transferred to and formed on the intermediate transfer belt 6*a*. In a tandem-type image forming apparatus including a plurality of photoconductors 1 corresponding to the number of a plurality of color toners, the primary transfer process is repeated a plurality of times to form, on the intermediate transfer belt 6*a*, a color toner image in which a plurality of colors are superimposed.

The recording medium sent out from the sheet feeding cassette 9 or the manual sheet feeding tray 31 is conveyed to the registration roller pair 11 by conveying rollers, while being guided by conveying guides (not illustrated). The toner image on the intermediate transfer belt 6*a* is transferred to the recording medium sent out from the registration roller pair 11 at predetermined timing such that the superimposed color toner image on the intermediate transfer belt 6*a* meets the recording medium in the secondary transfer area in which the secondary transfer roller 6*g* and the intermediate transfer belt 6*a* face each other. The transfer process is performed in the secondary transfer area with the action of the transfer electric field and nip pressure of the secondary transfer roller 6*g*.

With this transfer process, a full-color toner image is formed on the recording medium. The recording medium formed with the full-color toner image passes through between a heating roller 8*a* and a pressure roller 8*b* in the fixing device 8. During the passage, the full-color toner image is fixed on the recording medium. Thereafter, the recording medium passes through a sheet discharging roller 12, and is discharged on the sheet discharging tray 30 of the image forming apparatus 100.

The image forming apparatus 100 of the present embodiment has two printing speeds (i.e., image forming speeds) used in the image forming operation. One of the printing speeds is a standard speed used in a normal printing operation (i.e., image forming operation), which corresponds to a linear velocity of approximately 120 mm/sec (millimeters per second). The other one of the printing speeds is a half speed used in the passage of a relatively thick sheet having a relatively low heat transfer efficiency, which corresponds to a linear velocity of approximately 60 mm/sec. The two printing speeds can be selected in accordance with, for example, the type of sheet.

Meanwhile, prior to the transfer process, the surface potential of the photoconductor 1 is approximately −500 volts in a white background area and approximately −50 volts in an image area exposed to the scanning light 4*a* emitted from the laser. Due to a development bias voltage formed by a direct-current voltage of approximately −500 volts and an alternating-current voltage in a range of from approximately 0.5 kilovolts to approximately 2 kilovolts, the negative-polarity toner is developed in the image area. In the primary transfer area, the toner image is transferred to the intermediate transfer belt 6*a* due to a transfer bias voltage formed by a positive-polarity direct-current voltage in a range of from approximately +400 volts to approximately +450 volts and a positive-polarity alternating-current voltage in a range of from approximately 0.5 kilovolts to approximately 2 kilovolts.

Due to the transfer electric field, the surface potential of the photoconductor 1 after the primary transfer process is approximately −200 volts in the white ground area and approximately −10 volts in the image area. Due to the electric field of approximately −200 volts and approximately −10 volts, the toner on the photoconductor 1 after the transfer process firmly adheres to edge portions of the image on the surface of the photoconductor 1. Therefore, the toner escapes the cleaning member 7*a*, and the charging process is performed with the toner remaining on the surface of the photoconductor 1. As a result, an abnormal image is formed in which the toner adheres to the white background area or white spots are formed, for example. In view of this, the electric field remaining on the surface of the photoconductor 1 is applied with light from the PCL 20. Thereby, an electric field is formed in which the background area having no toner has a potential of approximately 0 volt changed from approximately −200 volts and the image area has a potential of approximately −10 volts. Accordingly, the adhesion force of the toner to the photoconductor 1 is reduced, and cleaning failure is suppressed.

Thereafter, the lubricant supplying and cleaning member 21*a* formed by a brush roller comes into contact with and scrapes off the solid-state lubricant 21*b*, and conveys the scraped lubricant 21*b* to a position facing the photoconductor 1 to supply the lubricant 21*b* to the photoconductor 1. Then, the lubricant supplying and cleaning member 21*a* cleans the residual toner off the photoconductor 1 by using electrostatic force generated by a bias voltage of approximately +100 volts applied to a core bar of the lubricant supplying and cleaning member 21*a* and physical force generated by the contact between the photoconductor 1 and the lubricant supplying and cleaning member 21*a*.

Then, the cleaning member 7*a* in contact with the photoconductor 1 presses and spreads the lubricant 21*b* into a thin layer. The thin layer reduces the friction coefficient of the photoconductor 1. In this process, the friction coefficient μ of the photoconductor 1 is preferably reduced to approximately 0.4 or lower. With the friction coefficient of the photoconductor 1 thus reduced, abnormal noise can be prevented from occurring due to the friction between the photoconductor 1 and the cleaning member 7*a*. Further, the reduction in the friction coefficient of the photoconductor 1 suppresses the deformation and warpage of the cleaning member 7*a*. Accordingly, it is possible to prevent the toner from escaping the cleaning member 7*a*, and to suppress the cleaning failure. In addition, the reduction in the friction coefficient of the photoconductor 1 makes it easier to clean off the toner on the photoconductor 1. Further, the adhesion force of the toner adhering to the surface of the photoconductor 1 is reduced. Therefore, even residual toner having a circularity degree of approximately 0.94 or higher can be cleaned off.

In the present embodiment, a lubricant application mode refers to a mode for driving the photoconductor 1 without performing the image forming operation, i.e., a mode for idling the photoconductor 1. The timing, the time, and the speed of supplying the lubricant 21*b* from the lubricant supplying and cleaning member 21*a* to the photoconductor 1 are determined, and the lubricant application mode is executed as required in a between-sheet interval or in a fixing reload time described later to effectively apply and spread the lubricant 21*b* into a thin layer and reduce the friction coefficient of the photoconductor 1 to prevent the occurrence of abnormal noise. In the lubricant application mode, the intermediate transfer belt 6*a* is driven in synchronization with the driving of the photoconductor 1 to prevent a scratch from being formed due to the friction between the intermediate transfer belt 6*a* and the photoconductor 1. Further, in the driving of the photoconductor 1, a bias voltage may be applied to the charging device 3 and the development device 5 to make the surface potential of the photoconductor 1 and the potential of the development bias voltage the same between the driving operation of the photoconductor 1 and the image forming operation. Meanwhile, the exposure operation and the transfer operation are not performed.

A method of controlling the lubricant application mode according to an embodiment of the present invention will be described. The lubricant supplying and cleaning member 21*a* and the cleaning member 7*a* are constantly in contact with the photoconductor 1. Therefore, if the lubricant application mode is executed to drive the photoconductor 1 without performing the image forming operation, i.e., to perform the idling of the photoconductor 1, the lubricant 21*b* is supplied from the lubricant supplying and cleaning member 21*a* to the photoconductor 1, and is spread into a thin layer by the cleaning member 7*a*. Accordingly, the friction coefficient of the photoconductor 1 is reduced, and the occurrence of abnormal noise is prevented. Particularly in the present embodiment, factors such as the timing and degree of lubricant application in the operation in the lubricant application mode are controlled on the basis of recent print information (i.e., image forming information). Therefore, the lubricant application is performed before abnormal noise occurs.

Prior to the image forming operation at a relatively low printing speed, in which abnormal noise tends to occur, an appropriate amount of the lubricant 21*b* is applied to the surface of the photoconductor 1 on the basis of the recent print information. Thereby, the friction coefficient of the photoconductor 1 is reduced, and the occurrence of abnormal noise is prevented. Further, before the image forming apparatus 100 falls into a condition in which abnormal noise tends to occur due to an increase in the friction coefficient of the photoconductor 1 over time in consecutive printing (i.e., consecutive image formation), the lubricant application mode is executed to apply an appropriate amount of the lubricant 21*b* to the photoconductor 1. Thereby, the friction coefficient of the photoconductor 1 is reduced, and the occurrence of abnormal noise is prevented. Further, the occurrence of abnormal noise can be prevented without a special component for preventing the abnormal noise. Further, abnormal noise can be prevented with no need to strictly set the characteristic values of the cleaning device 7. Accordingly, it is possible to perform a cleaning operation not substantially affected by the variation in characteristic values of the cleaning device 7 due to the variation in components thereof.

Figure 7:
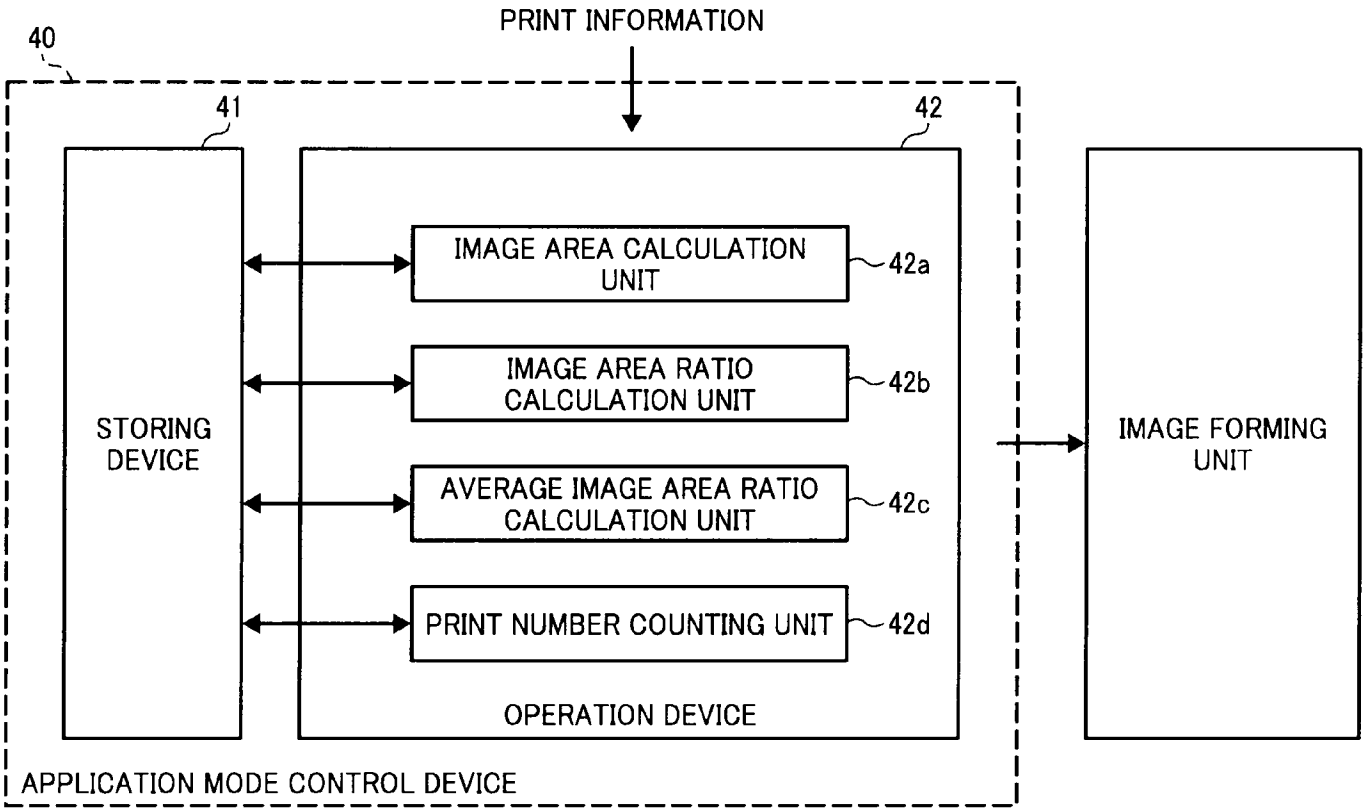
FIG. 7 is a block diagram illustrating a configuration of an application mode control device.

The function of an application mode control device 40 (FIG. 7) for controlling the lubricant application mode may be performed by, for example, a storing device 41, an operation device 42, and so forth normally used in an image forming apparatus to perform an image forming process control. The operation device 42 calculates an image area, an image area ratio, and an average image area ratio based on print information. The operation device 42 further counts the number of printed recording media. The operation device 42 inputs information to and outputs information from the storing device 41. Accordingly, the operations of the application mode are controlled based on calculation results of the operation device 42.

Alternatively, a special control device configured to include an application mode control device, a storing device, and so forth may be provided. In any of the cases, the application mode control device 40 inputs and outputs information to and from a control device which performs the image forming process control, and operates in conjunction with the control device.

The application mode control device 40 inputs information such as the recent print information and the printing speed (i.e., the rotation speed of the photoconductor 1) used in the image forming operation to be performed. On the basis of empirical values, the application mode control device 40 calculates the timing of idling the photoconductor 1 (e.g., the value n in the execution of the lubricant application mode in the between-sheet interval which corresponds to the n number of images), the idling time (or the number of idling operations), the linear velocity of the photoconductor 1 in the idling operation, and so forth. Then, the application mode control device 40 executes the lubricant application mode by controlling a drive device for driving the photoconductor 1 and process members provided around the photoconductor 1.

Figure 4:
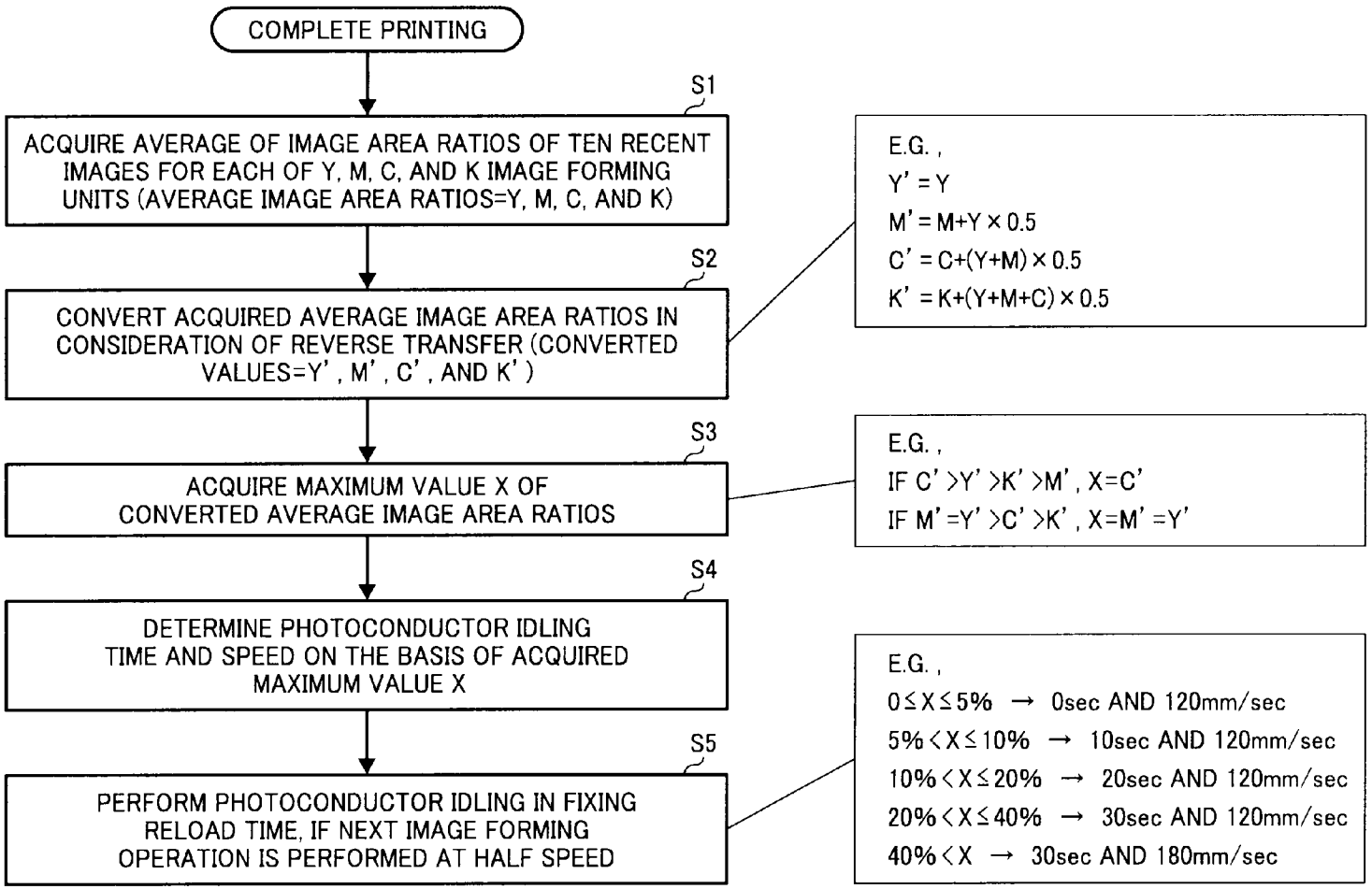
FIG. 4 is a flowchart explaining a control example.

With reference to FIG. 4, an example of the control procedure performed by the application mode control device 40 will be described. The application mode control device 40 includes the operation device 42 that includes an image area calculation unit 42*a*, an image area ratio calculation unit 42*b*, and an average image area ratio calculation unit 42*c*. The image area calculation unit 42*a* calculates the image area in the image forming operation. The image area ratio calculation unit 42*b* calculates an image area ratio, which is the ratio of the image area to the corresponding area of the surface of the photoconductor 1 (i.e., the image carrier), i.e., the movement area of the photoconductor 1. The average image area ratio calculation unit 42*c* calculates the average value of the image area ratios of recently printed images. On the basis of the image area ratio, the application mode control device 40 controls the operation in the lubricant application mode. If a relatively large number of the images have a relatively high image area ratio, i.e., if the increase in the friction coefficient of the photoconductor 1 is relatively large, the application mode control device 40 increases the amount of lubricant to be applied. Meanwhile, if a relatively large number of the images have a relatively low image area ratio, i.e., if the increase in the friction coefficient of the photoconductor 1 is relatively small, the application mode control device 40 reduces the amount of lubricant to be applied. Therefore, the amount of lubricant to be applied can be controlled in accordance with recent printing conditions. Accordingly, abnormal noise can be reliably and effectively prevented.

At step S-1, upon completion of the printing operation of the previous job, the image area calculation unit 42*a* of the operation device 42 of the application mode control device 40 inputs the image data of the images most recently printed by the image forming apparatus 100, and calculates the image area of ten recent images. The image area ratio calculation unit 42*b* calculates the image area ratio, which is the ratio of the image area to the area passed by the photoconductor 1 per hour, on the basis of the printing speed in the printing operation (i.e., the moving speed of the photoconductor 1). The average image area ratio calculation unit 42*c* calculates the average image area ratio by averaging ten image area ratio data items calculated by the image area ratio calculation unit 42*b*. The above-described calculations are performed for each of the image forming units 2Y, 2M, 2C, and 2K. The respective average image area ratios of the image forming units 2Y, 2M, 2C, and 2K will be referred to as Y, M, C, and K, for example.

To determine the execution or non-execution of the lubricant application mode and the lubricant application amount (i.e., the lubricant application time and speed) in accordance with the average image area ratio, experimental data has previously been stored in the storing device 41 of the application mode control device 40. If the image area ratio is known, therefore, the execution or non-execution of the lubricant application mode and the lubricant application amount can be set. In fact, however, the toner on the intermediate transfer belt 6*a* adheres to the surface of the photoconductor 1 due to reverse transfer. In a tandem-type image forming apparatus, as in the present example, the more downstream the image forming unit 2 (i.e., the image forming unit 2Y, 2M, 2C, or 2K) is located, the more reverse transfer toner is input to the image forming unit 2 in the image forming operation. The most downstream image forming unit 2 receives an input of the largest amount of reverse transfer toner collected from the other image forming units 2 located upstream thereof. If the amount of the toner adhering to the photoconductor 1 due to the reverse transfer is increased, the lubricant application efficiency is reduced. At step S-12, therefore, a correction operation is performed as follows in consideration of the adhesion of the toner due to the reverse transfer.

At step S-2, in consideration of the reverse transfer, the application mode control device 40 performs the correction operation to convert the average image area ratios calculated at step S-1. The converted average image area ratios are represented as Y', M', C', and K', for example. The average image area ratios prior to the conversion are Y, M, C, and K in the order from the upstream side. Therefore, the average image area ratios Y, M, C, and K are converted into the average image area ratios $Y'=Y$, $M'=M+Y\times0.5$, $C'=C+(Y+M)\times0.5$, and $K'=K+(Y+M+C)\times0.5$, respectively, wherein 0.5 represents an example of empirical constant.

At step S-3, the application mode control device 40 acquires the maximum value X of the average image area ratios converted at step S-2. For example, if the relationship $C'>Y'>K'>M'$ holds, the maximum value X is represented as $X=C'$. Further, if the relationship $M'=Y'>C'>K'$ holds, the maximum value X is represented as $X=M'=Y'$.

At steps S-4 and S-5, on the basis of the maximum value X of the average image area ratios acquired at step S-3, the application mode control device 40 determines the necessary idling time and linear velocity of the photoconductor 1, and performs the idling of the photoconductor 1.

For example, if the maximum value X is represented as $0\leqq X\leqq5\%$, the idling operation is performed with an idling time of 0 second and a linear velocity of 120 mm/sec. Further, if the maximum value X is represented as $5\%<X\leqq10\%$, the idling operation is performed with an idling time of 10 seconds and a linear velocity of 120 mm/sec. Further, if the maximum value X is represented as $10<X\leqq20\%$, the idling operation is performed with an idling time of 20 seconds and a linear velocity of 120 mm/sec. Further, if the maximum value X is represented as $20<X\leqq40\%$, the idling operation is performed with an idling time of 30 seconds and a linear velocity of 120 mm/sec. Further, if the maximum value X is represented as $40\%<X$, the idling operation is performed with an idling time of 30 seconds and a linear velocity of 180 mm/sec. Herein, the idling time corresponds to the lubricant application time, and the linear velocity corresponds to the lubricant application speed. With the control of the lubricant application time and the adjustment of the amount of lubricant applied to the photoconductor 1, excess and deficiency in the amount of lubricant applied to the photoconductor 1 can be prevented. Further, with the control of the lubricant application speed, it is possible to adjust the amount of lubricant applied to the photoconductor 1 per unit time, and to promptly perform the lubricant application.

The above description can be summarized as follows. The idling operation can be performed in the between-sheet interval. However, if the speed of the next image forming operation is reduced to the half speed, i.e., half the standard speed, the fixing speed of the fixing device 8 is also changed. Thus, there arises a waiting time before the fixing temperature is stabilized. Therefore, the idling operation is performed during this fixing reload time.

In the present embodiment, if the average image area ratio is in a range of from 0% to 5%, the lubricant application mode is not executed. That is, the lubricant application mode is executed when the average image area ratio exceeds 5%. Specifically, the highest area ratio is extracted from four average image area ratios of the image forming units 2Y, 2M, 2C, and 2K, and whether or not to execute the lubricant application mode is determined on the basis of the highest area ratio. Further, on the basis of the highest area ratio, the lubricant application time (i.e., the idling drive time of the photoconductor 1) and the lubricant application speed (i.e., the driving speed of the photoconductor 1) in the lubricant application mode are determined.

Whether or not to execute the lubricant application mode may be determined on the basis of the image area or the image area ratio, in place of the average image area ratio. Alternatively, the determination may be made on the basis of the calculation value calculated from the average image area ratio or the image area ratio. For example, the more downstream the image forming unit 2 (i.e., the image forming unit 2Y, 2M, 2C, or 2K) is located, the more reverse transfer toner is input to the image forming unit 2 in the image forming operation. The most downstream image forming unit 2 receives an input of the largest amount of reverse transfer toner collected from the other image forming units 2 located upstream thereof. Therefore, it is also possible to perform calculation in consideration of the input of the reverse transfer toner, extract the highest calculation value from the respective calculation values of the four image forming units 2, and then determine whether or not to execute the lubricant application mode on the basis of the highest calculation value.

When the printing speed is the half speed, the lubricant application mode is executed in the fixing reload time. When the image forming operation at the standard speed or the standby state shifts to the image forming operation at the half speed, the fixing temperature needs to be changed to a temperature suitable for the image forming operation at the half speed. The increase or decrease in the fixing temperature and the value of the fixing temperature vary, depending on the state of the fixing device 8 before the start of the image forming operation at the half speed. The time for changing the fixing temperature corresponds to the waiting time. The lubricant application mode is executed during the waiting time. Thereby, the waiting time necessary for executing the lubricant application mode can be eliminated or reduced. Further, abnormal noise due to the friction between the photoconductor 1 and the cleaning member 7*a* tends to occur when the printing speed is relatively low. Therefore, the execution of the lubricant application mode at the above-described timing is substantially effective in suppressing the abnormal noise.

Figure 5:
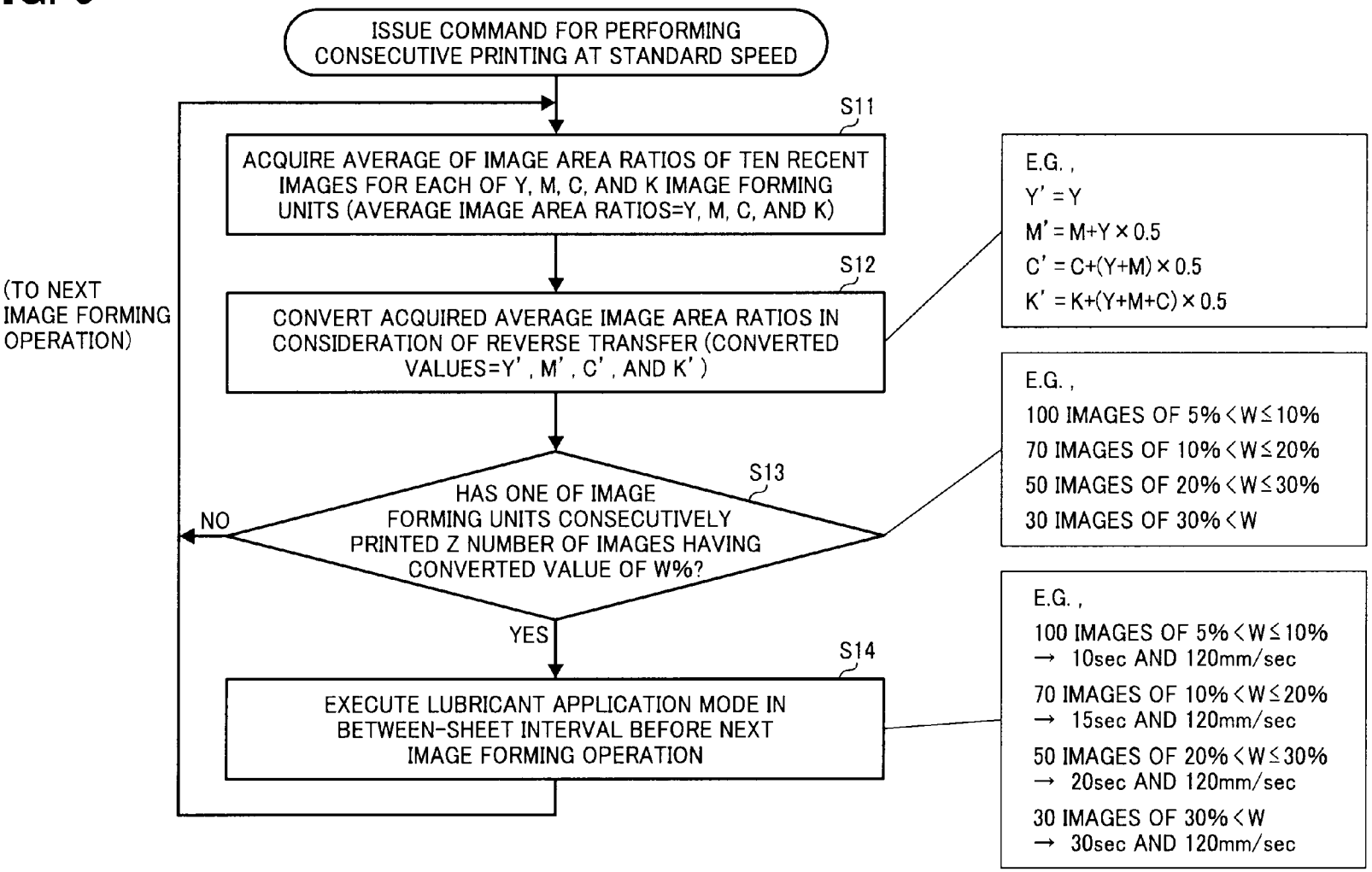
FIG. 5 is a flowchart explaining another control example.
Figure 6:
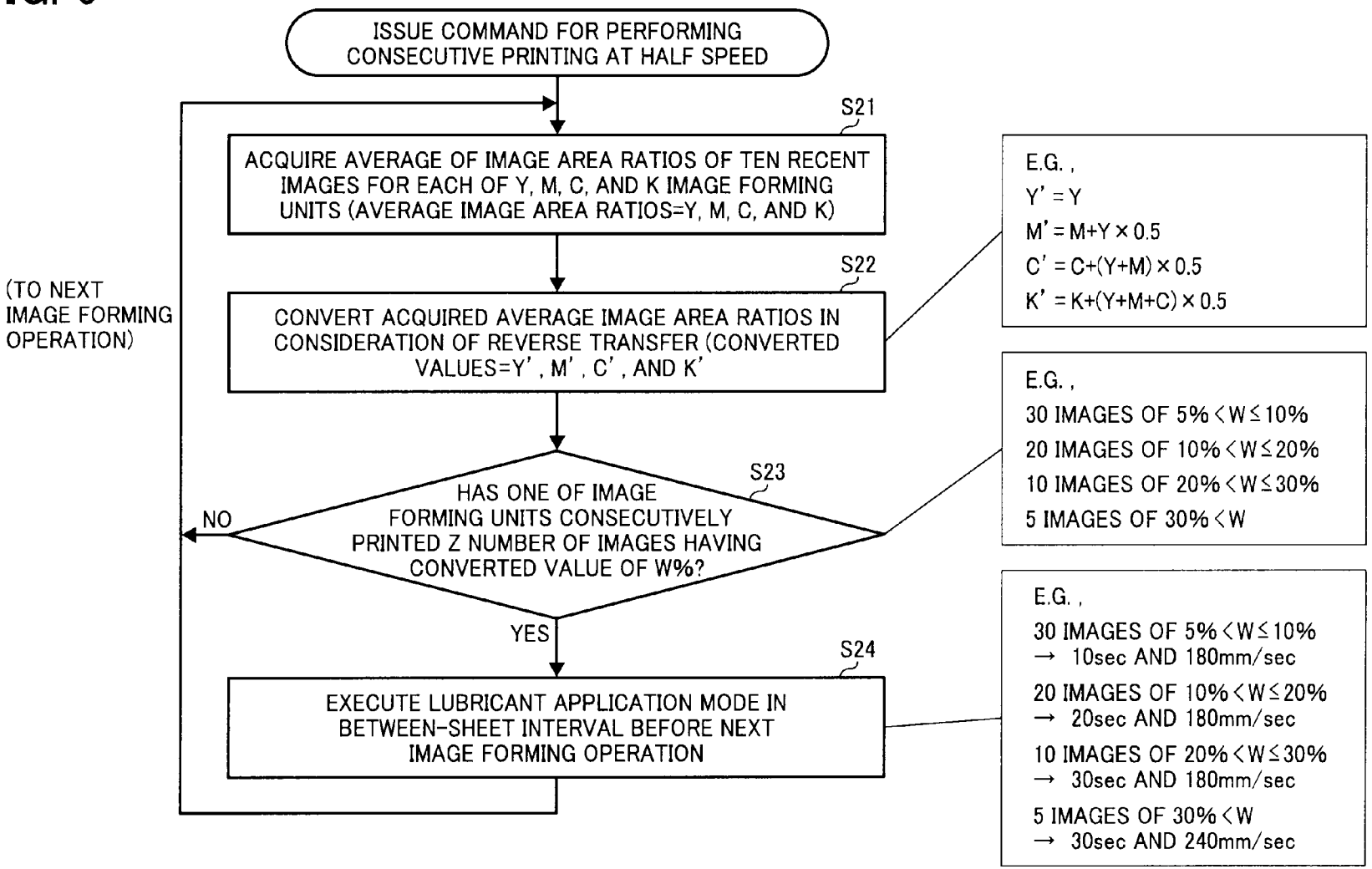
FIG. 6 is a flowchart explaining still another control example.

Another method of controlling the lubricant application mode according to an embodiment of the present embodiment will be described. The lubricant application mode is also executed in a between-recording media interval in the printing operation, i.e., in a so-called between-sheet interval prior to the next image forming operation. FIG. 5 illustrates a control method performed in consecutive printing at the standard printing speed (i.e., the standard speed), and FIG. 6 illustrates a control method performed in consecutive printing at the half speed, i.e., half the standard speed.

The two control methods are the same as the foregoing control method in that the control methods are performed by the image forming apparatus 100 including the image area calculation unit 42*a* which calculates the image area in the image forming operation, the image area ratio calculation unit 42*b* which calculates the ratio of the image area to the movement area of the photoconductor 1 (i.e., the image carrier), and the average image area ratio calculation unit 42*c* which calculates the average value of the area ratios of recently printed images. The image forming apparatus 100 performing the two control methods further includes a print number counting unit 42*d*, which counts the number of printed recording media.

With the operation in the lubricant application mode controlled on the basis of the print number, it is possible to perform the lubricant application when the friction coefficient of the photoconductor 1 is increased due to the consecutive printing, and thus to suppress the increase in the friction coefficient. Further, with the combined use of the print number and the information of the image area ratio, it is possible to execute the lubricant application mode at a relatively short between-sheet interval when a relatively large number of the images have a relatively high image area ratio, and to execute the lubricant application mode at a relatively long between-sheet interval when a relatively large number of the images have a relatively low image area ratio. Accordingly, abnormal noise can be prevented from occurring due to the increase in the friction coefficient of the photoconductor 1 in the consecutive printing.

In the consecutive printing, the lubricant application efficiency is reduced due to charging hazard and post-transfer residues present on the photoconductor 1, and thus the friction coefficient of the lubricant 21*b* on the photoconductor 1 tends to increase. The increase in the friction coefficient may result in the occurrence of abnormal noise due to the friction between the photoconductor 1 and the cleaning member 7*a*.

In this case, the execution or non-execution of the lubricant application mode is determined on the basis of the printing speed and the number of consecutively printed images having a predetermined average image area ratio or a predetermined image area ratio. Then, the execution of the lubricant application mode and the lubricant application amount (i.e., the lubricant application time and speed) are determined, and the lubricant application is performed in the between-recording media interval in the printing operation.

Herein, the average image area ratio or the image area ratio may be replaced by the calculation value calculated from the image area or the image area ratio. Further, in the counting of the consecutively printed images, an image of the A4 size is counted as one, and an image of a size greater than the A4 size is counted as two. The count value counted by the print number counting unit 42*d* is used as the consecutive print number. Further, in the printing of an image having a relatively high image area ratio, the amount of the post-transfer residual toner is increased, and the lubricant application efficiency is reduced. As a result, the friction coefficient of the photoconductor 1 is quickly increased. Therefore, the between-sheet interval for executing the lubricant application mode is reduced. As for the printing speed, abnormal noise tends to occur in the image forming operation at the half speed. Therefore, the between-sheet interval for executing the lubricant application mode is set to be shorter than the between-sheet interval used in the image forming operation at the standard speed.

With the above-described configuration, abnormal noise can be prevented from occurring due to the friction between the photoconductor 1 and the cleaning member 7*a* along with the increase in the friction coefficient of the photoconductor 1 in the consecutive printing. Further, with the lubricant application mode incorporated in the between-recording media interval, the waiting time necessary for the lubricant application can be reduced.

Steps S-11 and S-12 in FIG. 5 and steps S-21 and S-22 in FIG. 6 correspond to steps S-1 and S-2 in FIG. 4 described above. At step S-13 in FIG. 5 or step S-23 in FIG. 6, if one of the image forming units 2Y, 2M, 2C, and 2K has consecutively printed the Z number of images in which the converted value acquired at step S-12 or S-22 corresponds to W % specified by an empirical rule (YES at step S-13 or S-23), the procedure proceeds to step S-14 or step S-24 to execute the lubricant application mode in the between-recording media interval in the printing operation (i.e., a so-called between-sheet interval prior to the next image forming operation). With the lubricant application mode executed in the between-recording media interval in the printing operation, it is possible to incorporate the lubricant application mode in the between-recording media interval, and thus to reduce the waiting time of the lubricant application. If the condition of step S-13 or S-23 is not satisfied, i.e., if none of the image forming units 2 has consecutively printed the Z number of images in which the converted value acquired at step S-13 or S-23 corresponds to the specified value of W % (NO at step S-13 or S-23), the procedure proceeds to the next image forming operation without executing the lubricant application mode, to perform the process of step S-11 or S-21.

Specifically, in the example of FIG. 5, the standard for determining whether or not to execute the lubricant application mode, i.e., the consecutive printing of the Z number of images having the converted value of W % is as follows, as illustrated in the drawing. In the first case, the value W is $5\%<W\leqq 10\%$ and the value Z is 100. In the second case, the value W is $10\%<W\leqq 20\%$ and the value Z is 70. In the third case, the value W is $20\%<W\leqq 30\%$ and the value Z is 50. In the fourth case, the value W is $30\%<W$ and the value Z is 10.

If the above conditions are satisfied, the lubricant application mode is executed in the following conditions. In the first case, the lubricant application mode is executed with a photoconductor idling time of 10 seconds and a photoconductor linear velocity of 120 mm/sec. In the second case, the lubricant application mode is executed with a photoconductor idling time of 15 seconds and a photoconductor linear velocity of 120 mm/sec. In the third case, the lubricant application mode is executed with a photoconductor idling time of 20 seconds and a photoconductor linear velocity of 120 mm/sec. In the fourth case, the lubricant application mode is executed with a photoconductor idling time of 30 seconds and a photoconductor linear velocity of 120 mm/sec.

In this case, the idling time corresponds to the lubricant application time, and the linear velocity corresponds to the lubricant application speed. With the control of the lubricant application time and the adjustment of the amount of lubricant applied to the photoconductor 1, excess and deficiency in the amount of lubricant applied to the photoconductor 1 can be prevented. Further, with the control of the lubricant application speed, it is possible to adjust the amount of lubricant applied to the photoconductor 1 per unit time, and to promptly perform the lubricant application.

Similarly, in the example of FIG. 6, the standard for determining whether or not to execute the lubricant application mode, i.e., the consecutive printing of the Z number of images having the converted value of W % is as follows, as illustrated in the drawing. In the first case, the value W is $5\%<W\leqq 10\%$ and the value Z is 30. In the second case, the value W is $10\%<W\leqq 20\%$ and the value Z is 20. In the third case, the value W is $20\%<W\leqq 30\%$ and the value Z is 10. In the fourth case, the value W is $30\%<W$ and the value Z is 5.

If the above conditions are satisfied, the lubricant application mode is executed in the following conditions. In the first case, the lubricant application mode is executed with a photoconductor idling time of 10 seconds and a photoconductor linear velocity of 180 mm/sec. In the second case, the lubricant application mode is executed with a photoconductor idling time of 20 seconds and a photoconductor linear velocity of 180 mm/sec. In the third case, the lubricant application mode is executed with a photoconductor idling time of 30 seconds and a photoconductor linear velocity of 180 mm/sec. In the fourth case, the lubricant application mode is executed with a photoconductor idling time of 30 seconds and a photoconductor linear velocity of 240 mm/sec.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape, are not limited the embodiments and thus may be preferably set. It is therefore to be understood that within the scope of the appended claims, the disclosure of this patent specification may be practiced otherwise than as specifically described herein.

What is claimed is:

1. An image forming apparatus, comprising:

an image carrier driven to rotate and carry a latent image on a surface thereof;

a charging device to uniformly charge the surface of the image carrier;

an exposure device to perform, on the basis of acquired image data, an exposure operation on the charged surface of the image carrier to write the latent image thereon;

a development device to supply toner to the latent image to develop the latent image into a visible image;

a transfer device to transfer the visible image to one of an intermediate transfer member and a recording medium in a transfer operation;

a lubricant application device to apply lubricant to the surface of the image carrier;

a cleaning device to clean the surface of the image carrier subjected to the transfer operation, wherein the lubricant application device and the cleaning device are in constant contact with the image carrier;

a fixing device to fix, on the recording medium, the image transferred thereto; and a control device to control, on the basis of recent print information, operation of the lubricant application device to apply lubricant in a lubricant application mode in which the lubricant application device applies the lubricant to the surface of the image carrier without writing an image on the image carrier, wherein the control device comprises at least one of an image area ratio calculation device to calculate an image area ratio representing a ratio of the image area to a movement area of the image carrier, and an average image area ratio calculation device to calculate an average image area ratio representing an average value of the image area ratios of recently printed images, wherein the control device uses one of the image area ratio, the average image area ratio, and a calculation value calculated on the basis of the average image area ratio as the print information for controlling the operation of the lubricant application device in the lubricant application mode, and wherein the control device controls the operation of the lubricant application device to increase the amount of the lubricant applied in the lubricant application mode before writing the latent image on the image carrier when the one of the image area ratio, the average image area ratio, and a calculation value calculated on the basis of the average image area ratio is greater than a predetermined value.

2. The image forming apparatus according to claim 1, wherein the control device controls the operation of the lubricant application device in the lubricant application mode by changing a lubricant application time during which the lubricant application device applies the lubricant to the surface of the lubricant application device image carrier by changing the rotation time of the image carrier without writing an image on the image carrier.

3. The image forming apparatus according to claim 1, wherein the control device controls the operation of the lubricant application device in the lubricant application mode by changing a lubricant application speed at which the lubricant application device applies the lubricant to the surface of the image carrier by changing the rotation speed of the image carrier without writing an image on the image carrier.

4. The image forming apparatus according to claim 1, wherein the lubricant application mode is executed during a fixing reload time of the fixing device.

5. The image forming apparatus according to claim 1, wherein when the control device controls the operation of the lubricant application device to apply lubricant in the lubricant application mode when the one of the image area ratio, the average image area ratio, and a calculation value calculated on the basis of the average image area ratio is greater than a predetermined value, the lubricant application mode is executed in an interval between successively conveyed recording media in the image forming operation.

* * * * *